US006454551B2

(12) United States Patent
Kuroki et al.

(10) Patent No.: US 6,454,551 B2
(45) Date of Patent: Sep. 24, 2002

(54) SEAL STRUCTURE IN A SCROLL TYPE COMPRESSOR

(75) Inventors: Kazuhiro Kuroki; Hiroyuki Gennami; Kazuo Kobayashi; Yasushi Watanabe, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/861,730

(22) Filed: May 21, 2001

(30) Foreign Application Priority Data

May 24, 2000 (JP) ..... 2000-152452

(51) Int. Cl.[7] ..... F04C 18/04; F04C 27/00

(52) U.S. Cl. ..... 418/55.4; 418/55.5; 418/151; 418/188

(58) Field of Search ..... 418/55.4, 55.5, 418/57, 151, 188

(56) References Cited

FOREIGN PATENT DOCUMENTS

| | | | |
|---|---|---|---|
| JP | A-3-92502 | 4/1991 | |
| JP | 5-1682 | * 1/1993 | ..... 418/55.5 |
| JP | A-5-149270 | 6/1993 | |
| JP | A-8-319960 | 12/1996 | |
| JP | A-11-6487 | 1/1999 | |

* cited by examiner

*Primary Examiner*—John J. Vrablik
(74) *Attorney, Agent, or Firm*—Woodcock Washburn LLP

(57) ABSTRACT

The pressure leakage from the back pressure chamber installed at the back side of the movable scroll to the low pressure area can be prevented. An eccentric shaft (17) formed integrally to a drive shaft (14) is inserted into a bushing (19). A balance weight (18) is fixed to the bushing (19). A cylindrical portion (34) is provided so as to protrude at the back side of the movable scroll base (22), and the bushing (19) supports the cylindrical portion (34) via a needle bearing (21). A seal member (35) is interposed between the end surface of the cylindrical portion (34) and the balance weight (18). The inside of a cylinder of the cylindrical portion (34) is made to be a back pressure chamber (36).

8 Claims, 10 Drawing Sheets

SEAL STRUCTURE IN A SCROLL TYPE COMPRESSOR

BACKGROUND OF THE INVENTION

1. Field of the Invention

The present invention relates to a seal structure in a scroll type compressor.

2. Description of the Related Art

In order to improve the quality of a seal in a hermetic space formed between a fixed scroll and a movable scroll, a structure in which a back pressure is applied against a rear face of a movable scroll base, as disclosed in Japanese Unexamined Patent Publication (Kokai) No. 3-92502 and Japanese Unexamined Patent Publication (Kokai) No. 11-6487, is employed. At the rear face side of the movable scroll base, a back pressure chamber is formed, into which pressure as high as the discharge pressure is introduced. The rear side of the movable scroll base is used exclusively for a suction pressure area of low pressure, and a seal ring is interposed between the back pressure chamber and the suction pressure area in order to prevent pressure leakage from the back pressure chamber to the suction pressure area. A seal ring in the compressor which has been disclosed in Japanese Unexamined Patent Publication (Kokai) No. 3-92502, is installed so as to be contiguous with the end face of a boss cylinder and the bridge structure of the movable scroll. A seal ring in the compressor which has been disclosed in Japanese Unexamined Patent Publication (Kokai) No. 11-6487, is installed so as to be contiguous with the rear face of the movable scroll base and the inner surface of the housing.

In order to prevent pressure leakage between the movable scroll wall and the fixed scroll wall, it is advisable to press the movable scroll wall against the fixed scroll wall. For this reason, a structure is known in which the movable scroll is designed so as to be able to slightly move with the eccentric shaft in the direction of radius, and the movable scroll wall is pressed against the fixed scroll wall by utilizing the pressure in the hermetic space. In such structure, the movable scroll is allowed to tilt, that is, the eccentric axis of the movable scroll is allowed to tilt with respect to the axis of the eccentric shaft in the direction of the above-mentioned movement. When the eccentric axis of the movable scroll tilts with respect to the axis of the drive shaft of the compressor, the contact between the seal ring and the counterpart thereof becomes poor. Such a poor contact allows pressure leakage from the back pressure chamber to the low pressure area, and it is impossible to maintain a desired back pressure in the back pressure chamber. If it is impossible to keep the desired back pressure in the back pressure chamber, it is difficult to maintain a high quality seal in the hermetic space formed between the fixed scroll and the movable scroll.

SUMMARY OF THE INVENTION

The objective of the present invention is to prevent the pressure leakage from the back pressure chamber installed at the rear side of the movable scroll to the low pressure area.

In the present invention, therefore, a scroll type compressor is employed, wherein: a fixed scroll, on the base of which a fixed scroll wall is formed, is opposed to a movable scroll, on the base of which a movable scroll wall is formed; a hermetic space is formed between the movable scroll wall of the movable scroll and the fixed scroll wall, and the volume of the hermetic space decreases according to the orbital movement of the movable scroll; and the rotational force of the drive shaft is transmitted to the orbital movement mechanism, which comprises an eccentric shaft to provide the orbital movement to the movable scroll so that the movable scroll is allowed to orbit. In the first aspect of the present invention, the eccentric axis of the eccentric rotation body that eccentrically rotates together with the eccentric shaft is designed to be able to move corresponding to the eccentric axis of the movable scroll, a seal member is interposed between the movable scroll and the eccentric rotation body so that the seal member circumscribes the eccentric axis of the eccentric shaft, and the back pressure chamber is formed by the movable scroll, the eccentric rotation body and the seal member.

The eccentric rotation body is able to similarly tilt according to the inclination of the movable scroll. Therefore, the seal member interposed between the movable scroll and the eccentric rotation body is always in good contact with the movable scroll and the eccentric rotation body.

The present invention may be more fully understood from the description of the preferred embodiments of the invention set forth below, together with the accompanying drawings.

DESCRIPTION OF THE PREFERRED EMBODIMENTS

The first embodiment, in which the present invention is embodied, is explained according to FIG. 1 to FIG. 5.

Figure 1:
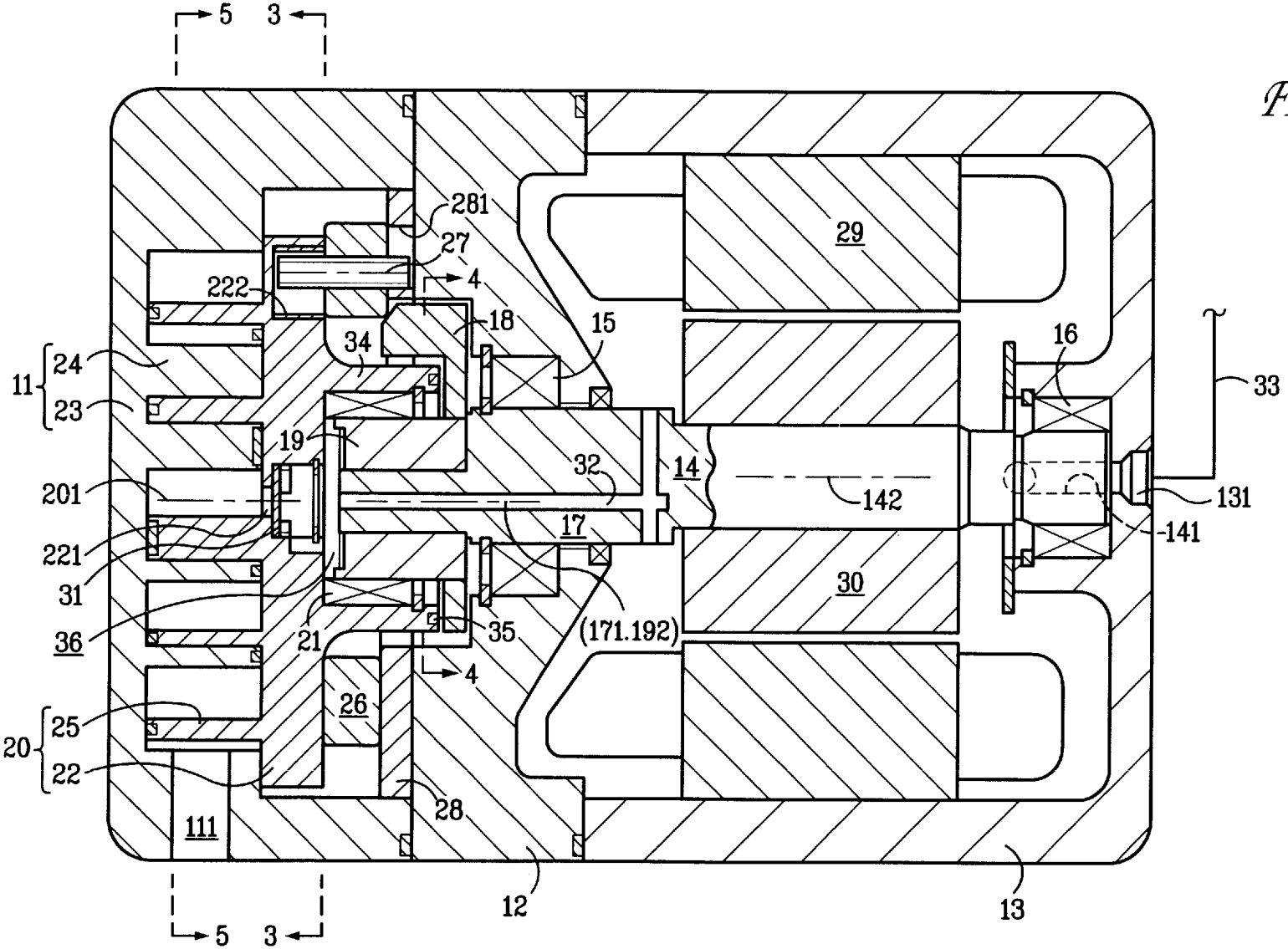
FIG. 1 is a profile cross-sectional view of the entire compressor in the first embodiment.

As shown in FIG. 1, a center housing 12 is coupled to a fixed scroll 11 and a motor housing 13 is coupled to the center housing 12. A drive shaft 14 is rotatably supported by the center housing 12 and the motor housing 13 via radial bearings 15 and 16, and an eccentric shaft 17 is formed integrally with the drive shaft 14.

Figure 4:
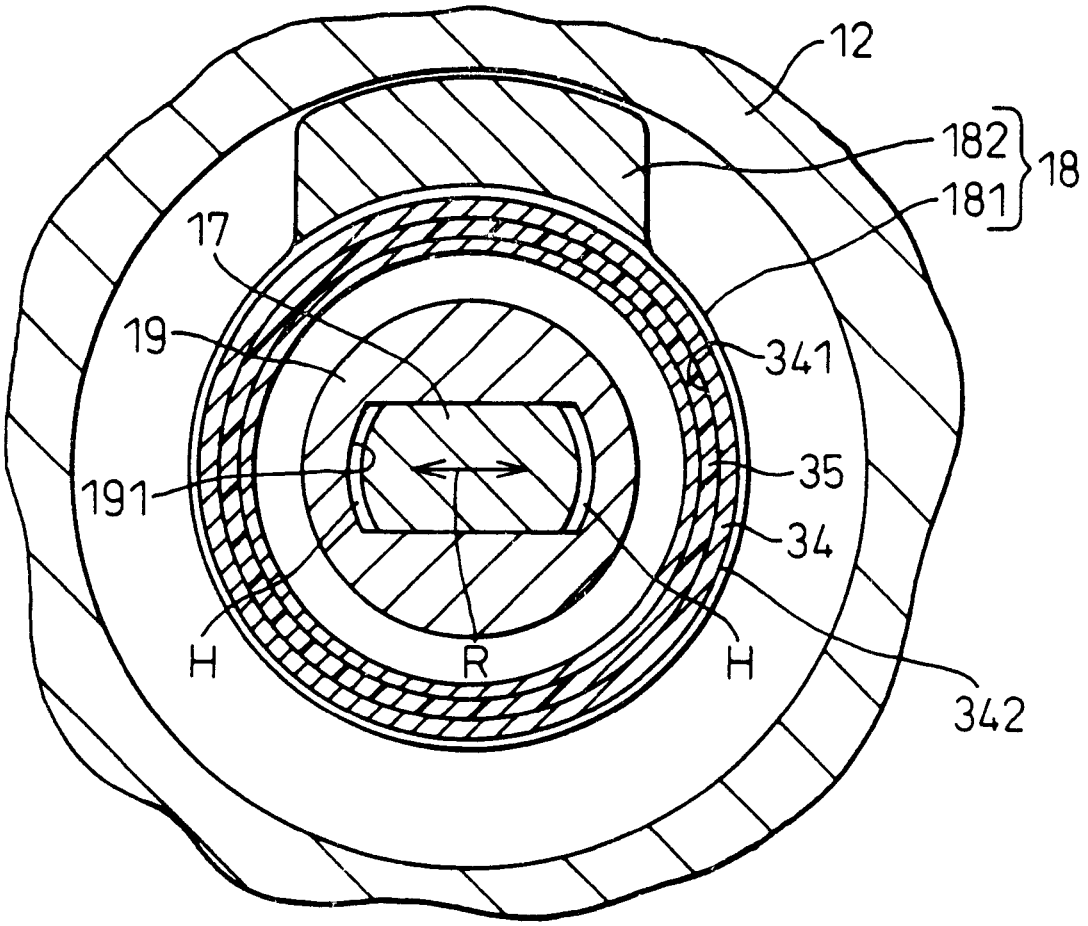
FIG. 4 is a section view taken along line 4—4 in FIG. 1.

As shown in FIG. 4, an insertion hole 191 is formed in a bushing 19 and the eccentric shaft 17 is inserted into the insertion hole 191. A space H is provided between the eccentric shaft 17 and the insertion hole 191, and the bushing 19 is able to slidably move in the direction of the arrow R with respect to the eccentric shaft 17. The bushing 19 and the eccentric shaft 17 rotate both integrally and eccentrically. A balance weight 18 is fixed to the bushing 19. The balance weight 18, which is an eccentric rotation body and eccentrically rotates together with the eccentric shaft 17, comprises a ring portion 181 fixed to the circumferential surface of the bushing 19 and a weight portion 182 formed integrally with the ring portion 181.

Figure 5:
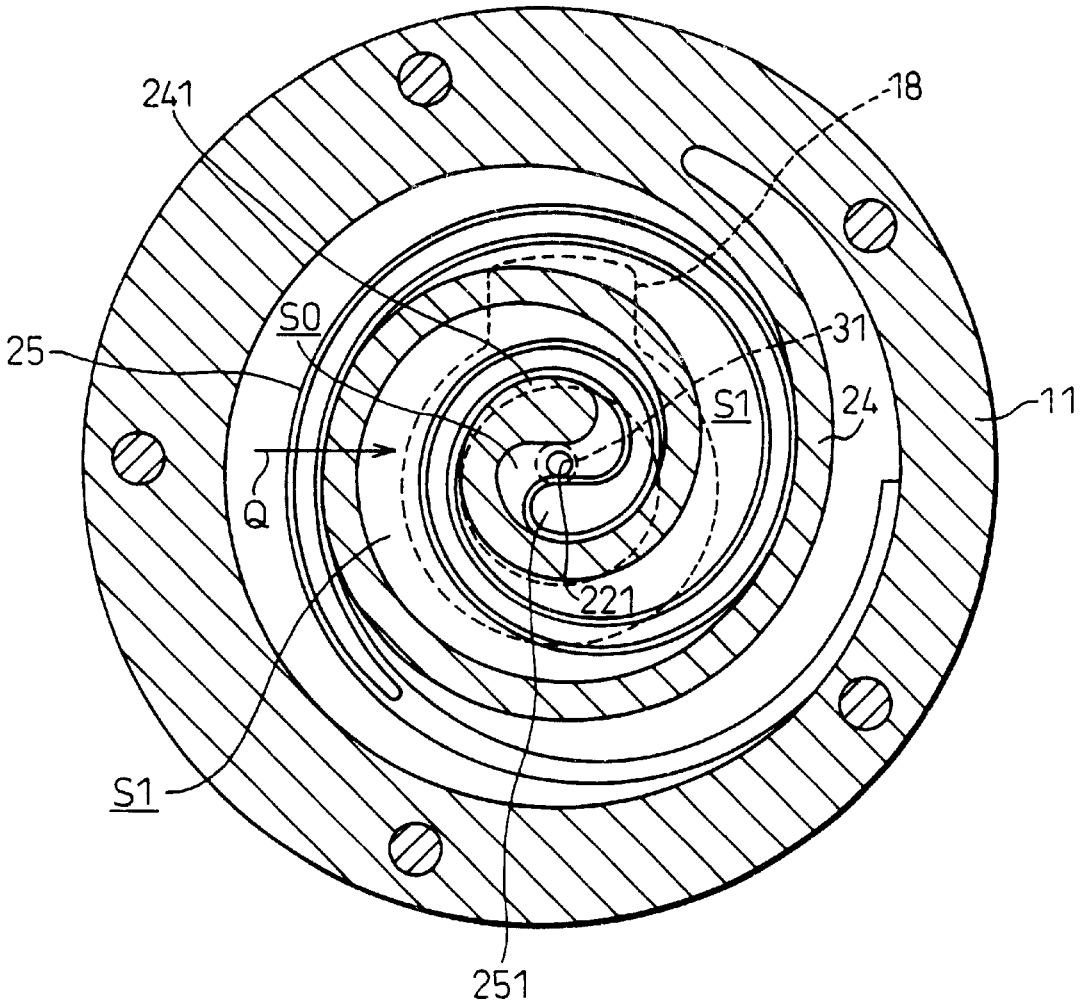
FIG. 5 is a section view taken along line 5—5 in FIG. 1.

As shown in FIG. 1, a movable scroll 20 is supported by the bushing 19 via a needle bearing 21 so that the movable scroll 20 is opposed to the fixed scroll 11 and performs a rotation relative thereto. The needle bearing 21 is housed in a cylinder of a cylindrical portion 34, which is provided so as to protrude at the rear side of a movable scroll base 22 of the movable scroll 20. A fixed scroll base 23 and a fixed scroll wall 24 of the fixed scroll 11, and the movable scroll base 22 and a movable scroll wall 25 of the movable scroll 20 form hermetic spaces S0 and S1, as shown in FIG. 5. The movable scroll 20 orbits according to the rotation of the eccentric shaft 17, and the balance weight 18 cancels out the centrifugal force caused by the orbital movement of the movable scroll 20 and the bushing 19. The eccentric shaft 17, which rotates integrally with the drive shaft 14, the bushing 19, the cylindrical portion 34 and the needle bearing 21 interposed between the eccentric shaft 17 and the cylindrical portion 34 of the movable scroll 20 constitute a orbital movement mechanism. The cylindrical portion 34, the needle bearing 21 and the bushing 19 constitute a transmitting means for eccentric rotation that transmits the eccentric rotation of the eccentric shaft 17 to the movable scroll 20.

Figure 3:
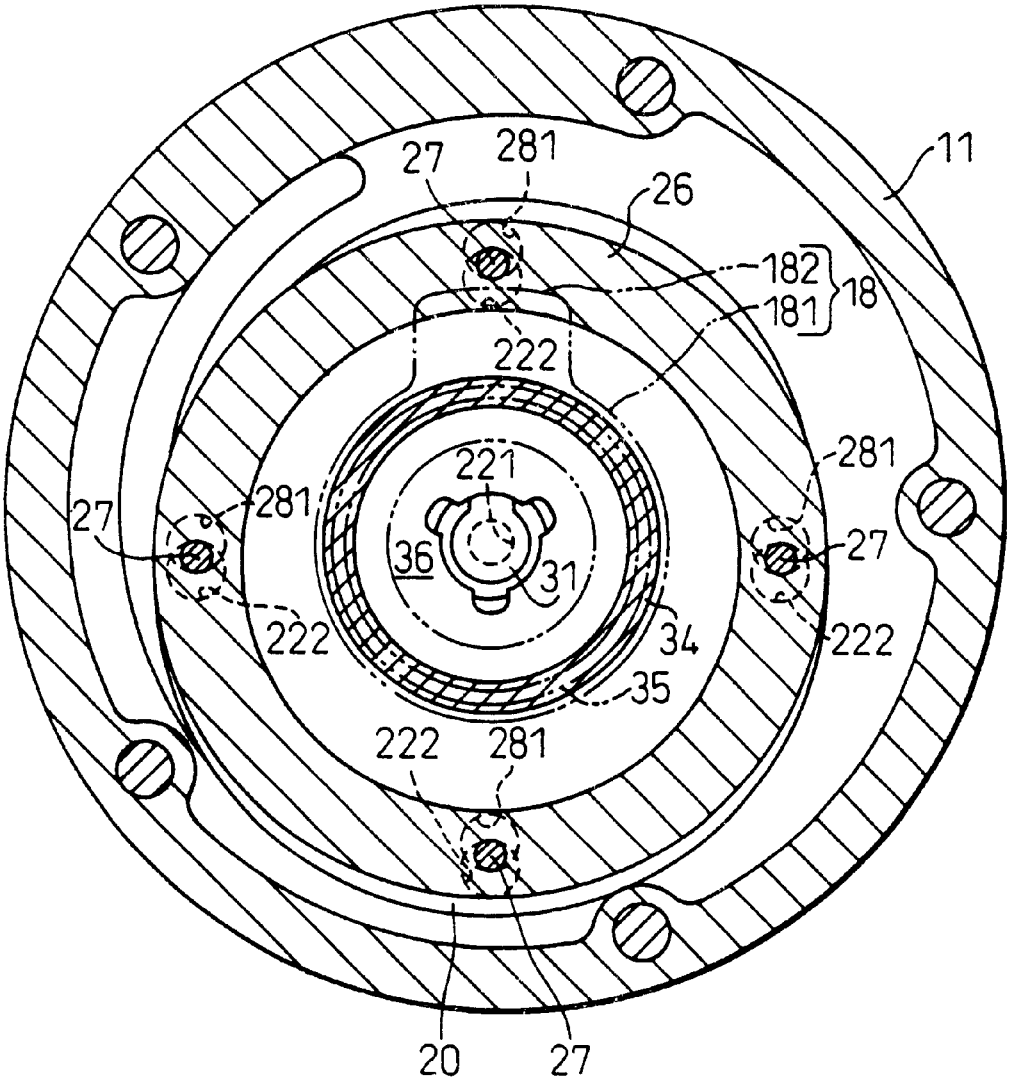
FIG. 3 is a section view taken along line 3—3 in FIG. 1.

As shown in FIG. 1, an orbiting ring 26 is interposed between the movable scroll base 22 and the center housing 12. Plural (four in the present embodiment) cylindrical self-rotation preventing pins 27 penetrate through and are fixed to the orbiting ring 26. An annular pressure-applied plate 28 is interposed between the center housing 12 and the orbiting ring 26. As shown in FIG. 3, self-rotation preventing holes 281, as many as there are self-rotation preventing pins 27, are arranged circumferentially on the pressure-applied plate 28. Self-rotation preventing holes 222, as many as there are self-rotation preventing pins 27, are arranged circumferentially on the movable scroll base 22. Both the self-rotation preventing holes 281 and 222 are equally spaced at the same angles. The end portion of each self-rotation preventing pin 27 is inserted into the self-rotation preventing holes 281 and 222.

A stator 29 is fixed to the inner circumferential surface of the motor housing 13 and a rotor 30 is supported by the drive shaft 14. Both the stator 29 and the rotor 30 constitute a motor and the rotor 30 and the drive shaft 14 rotate integrally when electrical energy is supplied to the stator 29.

The movable scroll 20 orbits according to the rotation of the eccentric shaft 17 integrally formed with the drive shaft 14, and the refrigerant gas introduced from an inlet 111 flows between the fixed scroll base 23 and the movable scroll base 22 from the circumferential sides of both the scrolls 11 and 20. According to the orbital movement of the movable scroll 20, the circumferential surface of the self-rotation preventing pin 27 comes into slidable contact with the circumferential surfaces of the self-rotation preventing holes 222 and 281. The relation D=d+r is specified, where D is a diameter of the self-rotation preventing holes 222 and 281, d is a diameter of the self-rotation preventing pin 27 and r is an orbit radius of the orbital movement of the bushing 19. This relation sets the radius of the orbital movement of the movable scroll 20 to r, and the orbiting ring 26 orbits with a radius half the orbit radius r of the movable scroll 20.

The orbiting ring 26 is prone to self-rotate spontaneously. But because three or more self-rotation preventing pins 27 are in contact with the inner circumferential surface of the fixedly arranged self-rotation preventing hole 281, the orbiting ring 26 does not self-rotate. The movable scroll 20 is prone to self-rotate spontaneously about the central axis of the bushing 19, but, because the inner circumferential surface of the self-rotation preventing hole 222 on the side of the movable scroll base 22 is in contact with the three or more self-rotation preventing pins 27 on the orbiting ring 26 that does not self-rotate, the movable scroll 20 does not self-rotate about the central axis of the bushing 19. Therefore, the movable scroll 20 and the orbiting ring 26 orbit without self-rotation. The hermetic spaces S1 and S0 shown in FIG. 5 continue to reduce their volumes according to the orbital movement of the movable scroll 20, and converge between the inner end portions 241 and 251 of the scroll walls 24 and 25 of the scrolls 11 and 20.

As shown in FIG. 1, a discharge port 221 is formed on the movable scroll base 22. The discharge port 221 communicates with the final hermetic space S0. The discharge port 221 is opened and closed by a float valve 31. A gas passage 32 is formed through the eccentric shaft 17 and the drive shaft 14.

Figure 2:
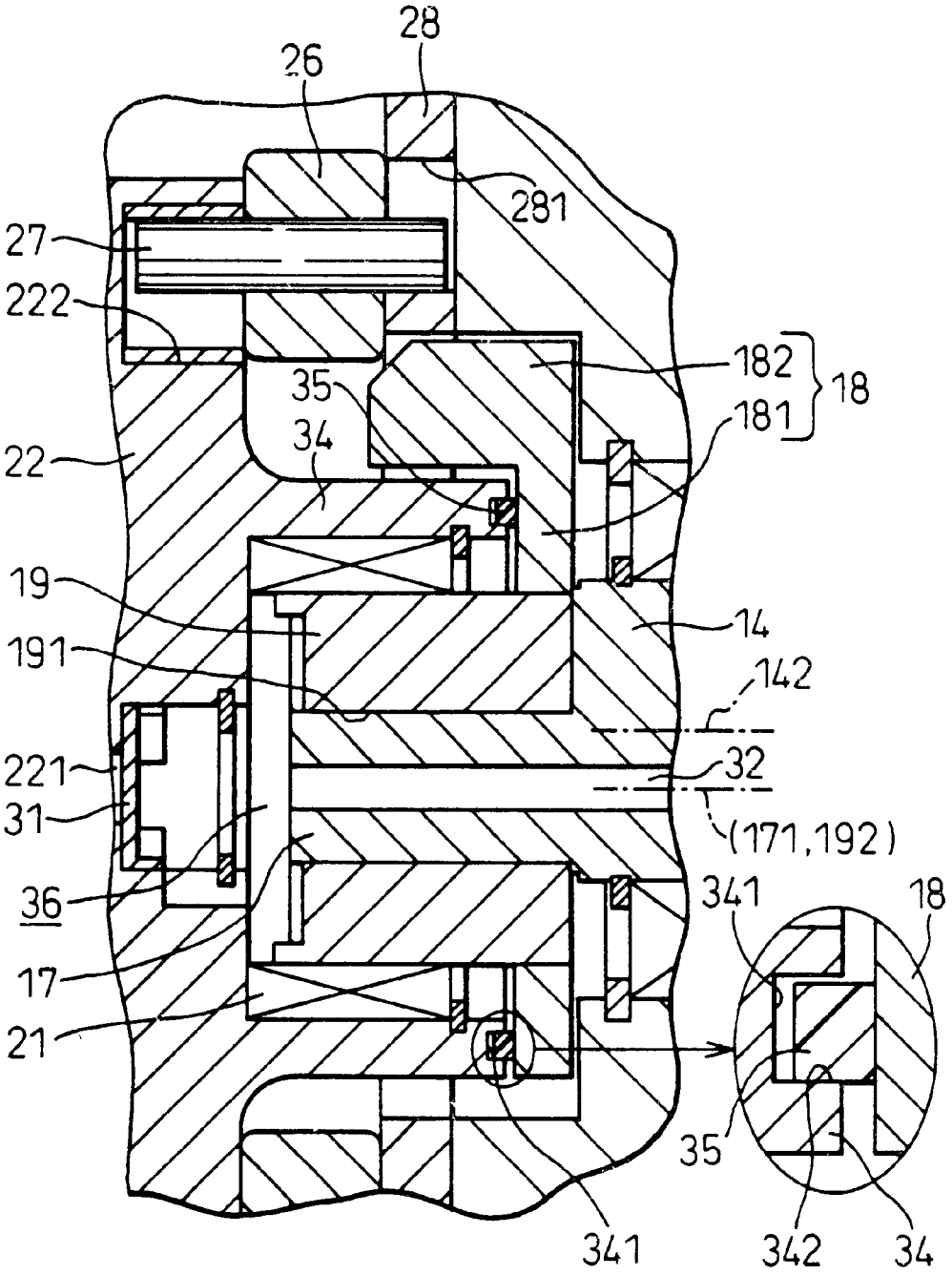
FIG. 2 is a section view with the major components magnified.

As shown in FIG. 2, an annular housing groove 341 is formed around the end surface of the cylindrical portion 34 and an annular seal member 35 made of synthetic resin is housed in a housing groove 341. The seal member 35, which surrounds an eccentric axis 171 of the eccentric shaft 17, is interposed between the end face of the cylindrical portion 34 and the ring portion 181 of the balance weight 18. The seal member 35 defines a back pressure chamber 36 in the cylindrical portion 34 together with the movable scroll base 22 and the ring portion 181 of the balance weight 18.

The refrigerant gas compressed due to the reduction in volume of the hermetic spaces S1 and S0 is discharged from the final hermetic space SO into the motor housing 13 through the discharge port 221, the back pressure chamber 36 and the gas passage 32. The refrigerant gas in the motor housing 13 is brought to an external refrigerant circuit 33 through a passage 141 in the drive shaft 14 and an exit 131 on the end wall of the motor housing 13. The back pressure chamber 36 in the cylindrical portion 34 becomes a high pressure discharge area and the back side of the movable scroll base 22 outside the cylindrical portion 34 becomes a low pressure suction area. The seal member 35 is pressed to and made to come into contact with the ring portion 181 of the balance weight 18 and a circumferential side surface 342 which is located radially outer side, of the housing groove 341 by the pressure inside the back pressure chamber 36. The seal member 35, which is pressed to and made to come into contact with the ring portion 181 and the circumferential side surface 342 of the housing groove 341, prevents pressure leakage between the suction pressure area of the back side of the movable scroll base 22 and the back pressure chamber 36.

The following effects can be obtained in the first embodiment.

(1-1)

As shown in FIG. 5, the pressures inside the hermetic spaces S0 and S1 bias the movable scroll 20 in the direction of the arrow Q. As shown in FIG. 4, the bushing 19 is able to slidably move with respect to the eccentric shaft 17 in the direction of the arrow R and the direction of the arrow R is set so as to approximately coincide with the direction of the arrow Q. Therefore, the movable scroll wall 25 of the movable scroll 20, which is biased in the direction of the arrow Q by the pressures inside the hermetic spaces S0 and S1, is pressed to and made to come into contact with the fixed scroll wall 24 of the fixed scroll 11. This pressing action, in which the movable scroll wall 25 is pressed to and made to come into contact with the fixed scroll wall 24, contributes to preventing pressure leakage from the hermetic spaces S0 and Sl through between the fixed scroll wall 24 and the movable scroll wall 25.

The structure which contributes to preventing pressure leakage and in which a sliding motion is allowed between the bushing 19 and the eccentric shaft 17, can accept the inclination of the bushing 19 in the direction of the arrow R, that is, the inclination, in the direction of the arrow R of an axis 192 of the bushing 19 with respect to the eccentric axis 171 of the eccentric shaft 17. Therefore the movable scroll 20 can incline in the direction of the arrow R. When the movable scroll 20 inclines in the direction of the arrow R, that is, when an eccentric axis 201 of the movable scroll 20 inclines with respect to an eccentric axis 171 of the eccentric shaft 17, the balance weight fixed to the bushing 19 inclines in the same direction. Since the axis 192 of the bushing 19 is also the eccentric axis of the balance weight 18, the eccentric axis 192 of the balance weight 18 inclines the same way that the eccentric axis 201 does, when the movable scroll 20 inclines. Therefore, the seal member 35 interposed between the cylindrical portion 34 of the movable scroll 20 and the ring portion 181 of the balance weight 18 comes into a good contact with the outer side surface 342 of the housing groove 341 and the ring portion 181. As a result, the seal member 35 can prevent pressure leakage from the back pressure chamber 36 to the suction pressure area at the back side of the movable scroll wall 25 without fail.

(1-2)

The end face of the cylindrical portion 34 that constitutes the orbital movement mechanism is a portion that comes close and is opposed to the ring portion 181 of the balance weight 18. Such an end face of the cylindrical portion 34 is best suited to the forming position of the housing groove 341 that houses the seal member 35.

(1-3)

The pressure inside the back pressure chamber 36 that resists the pressure in the hermetic space S0, in which the pressure is maximum in the area between the fixed scroll 11 and the movable scroll 20, is the discharge pressure. The structure, in which the discharge pressure is used as a back pressure directly, is best suited to provide an appropriate back pressure.

(1-4)

The structure, in which the discharge port 221 is installed on the movable scroll base 22, provides the shortest discharge passage to the back pressure chamber 36 at the back side of the movable scroll base 22. The structure that provides the shortest passage from the discharge port 221 to the back pressure chamber 36 has advantage in avoiding a complex structure inside a compressor, which provides a discharge passage.

Figure 6:
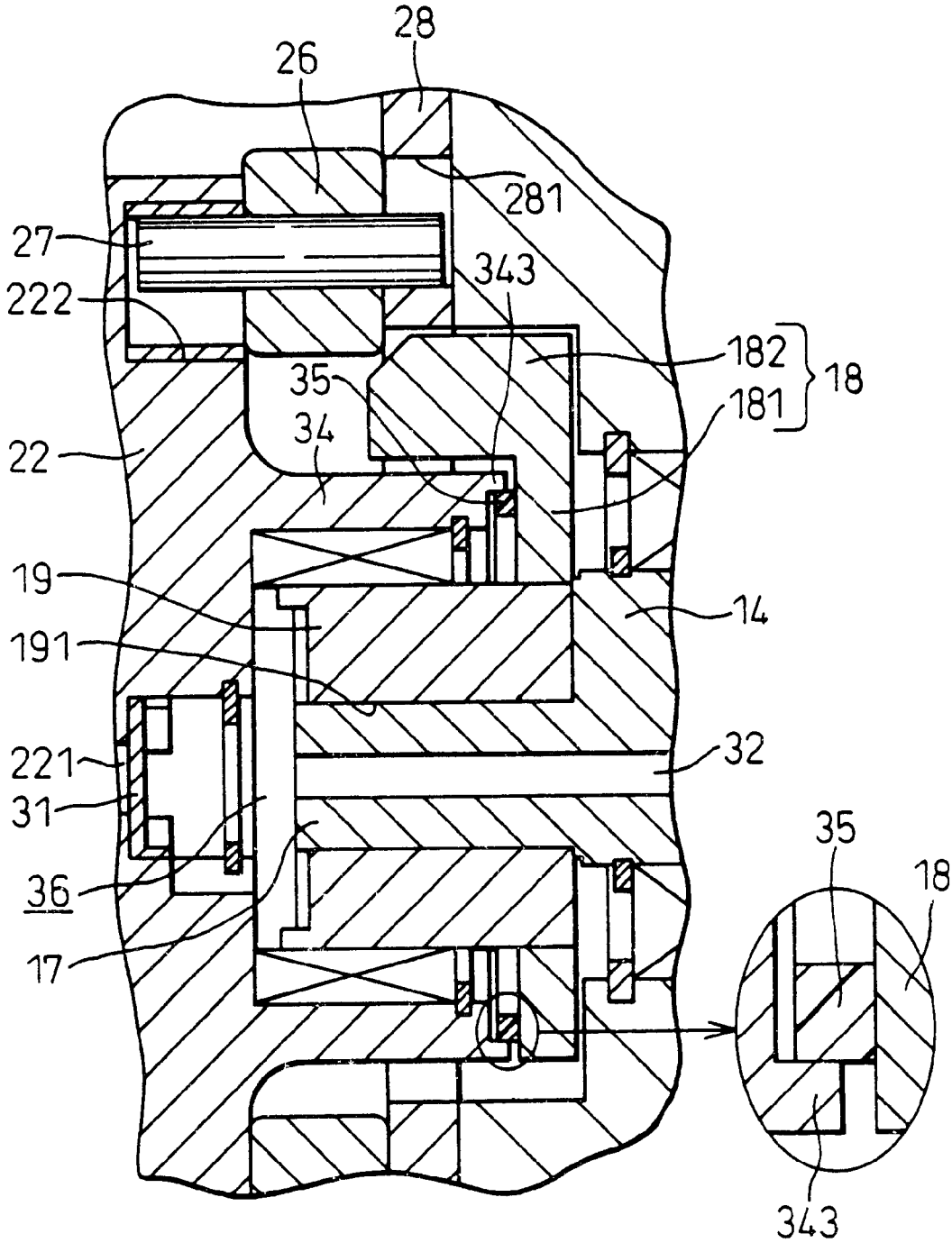
FIG. 6 is a profile cross-sectional view with the major components magnified in the second embodiment.

Next the second embodiment shown in FIG. 6 is described. The same symbols are used for the same elements as in the first embodiment.

An annular protruding portion 343 is formed on the end face of the cylindrical portion 34, and the seal member 35 is arranged on the radially inner side of the annular protruding portion 343. The seal member 35 is pressed to and made to come into contact with the ring portion 181 of the balance weight 18 and the protruding portion 343 by the pressure inside the back pressure chamber 36. The protruding portion 343 provides a simpler structure than that of the housing groove 341 in the first embodiment. It is advantageous to employ the protruding portion 343 rather than the housing groove 341 in reducing the wall thickness of the cylindrical portion 34. The reduction in wall thickness of the cylindrical portion 34 contributes to a reduction in weight of a compressor.

Figure 7:
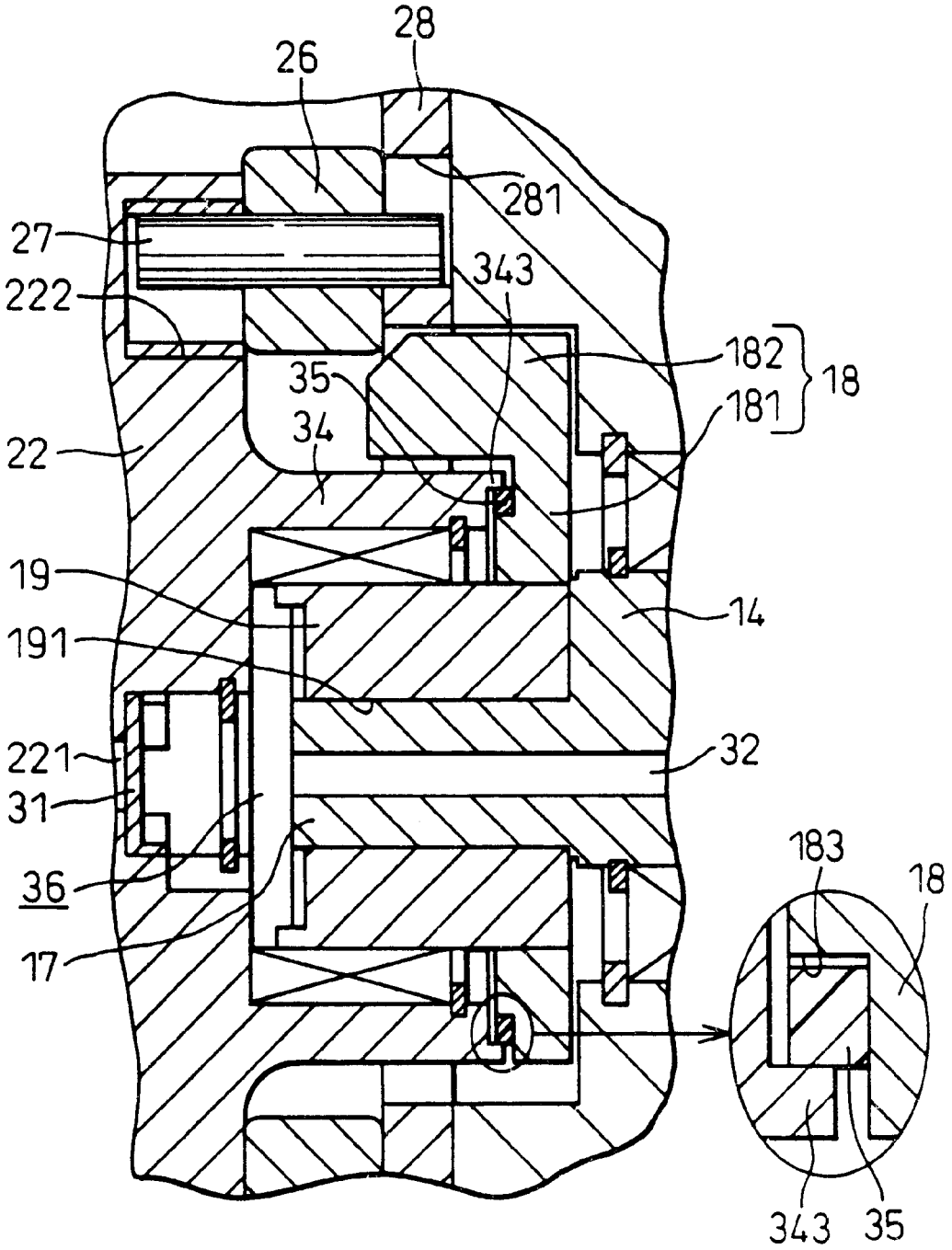
FIG. 7 is a profile cross-sectional view with the major components magnified in the third embodiment.

Next the third embodiment shown in FIG. 7 is described. The same symbols are used for the same elements as in the second embodiment.

A part of an outer circumferential surface 183 of the ring portion 181 of the balance weight 18 is designed so as to overlap with the protruding portion 343 when viewed from the direction perpendicular to the drive shaft 14. The outer circumferential surface 183 prevents the seal member 35 from being pulled toward the axis 192 of the bushing 19.

Figure 8:
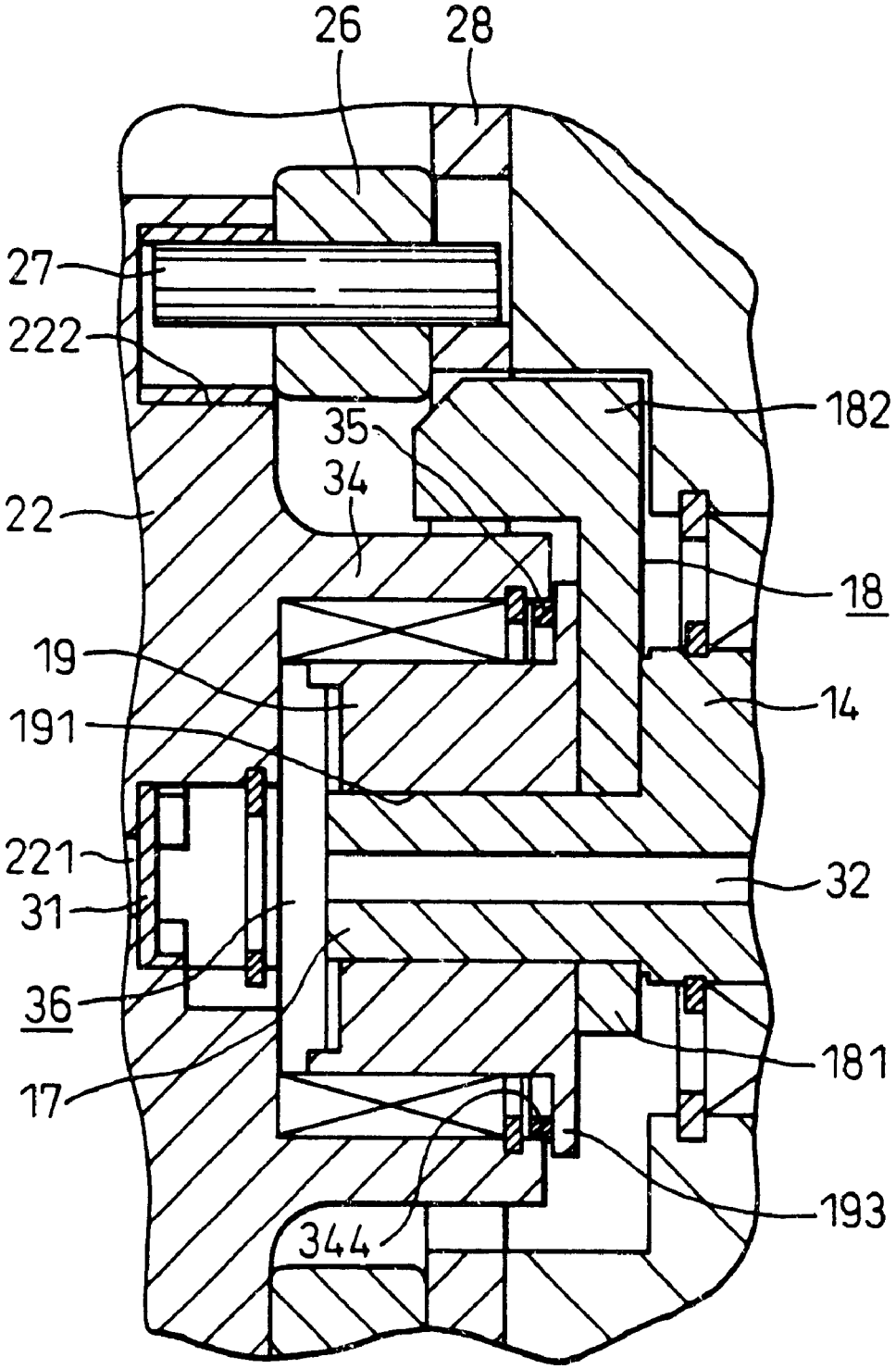
FIG. 8 is a profile cross-sectional view with the major components magnified in the fourth embodiment.

Next the fourth embodiment shown in FIG. 8 is described. The same symbols are used for the same elements as in the first embodiment.

The eccentric shaft 17 is inserted into the balance weight 18. A flange 193 is formed integrally to the bushing 19, which is an eccentric rotation body, and the seal member 35 is designed so as to be pressed to and made to come into contact with an inner circumferential surface 344 of the cylindrical portion 34 and the flange 193.

Figure 9:
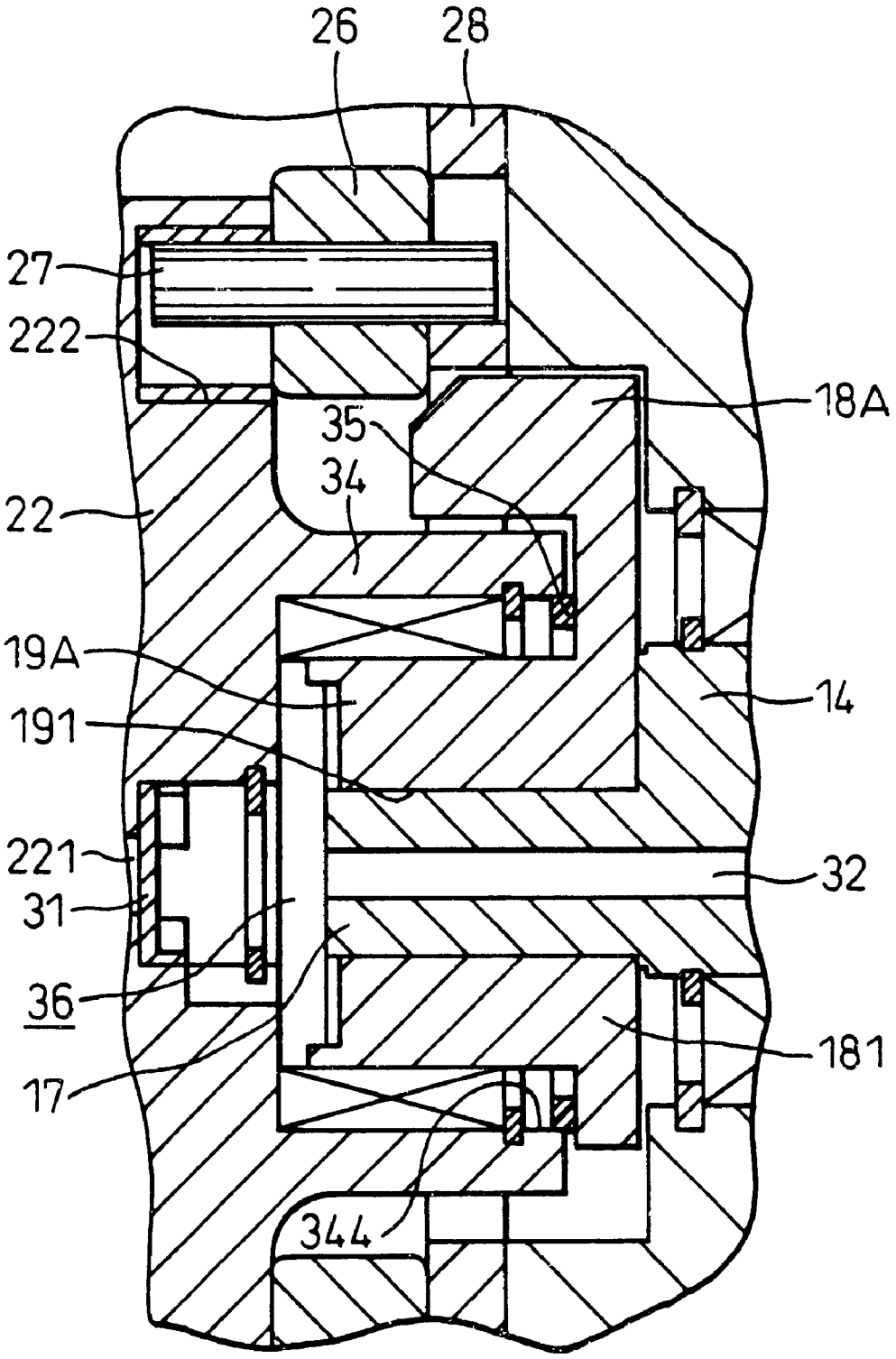
FIG. 9 is a profile cross-sectional view with the major components magnified in the fifth embodiment.

Next the fifth embodiment shown in FIG. 9 is described. The same symbols are used for the same elements as in the fourth embodiment.

A balance weight 18A is formed integrally to a bushing 19A, which is an eccentric rotation body. The seal member 35 is designed so as to be pressed to and made to come into contact with the inner circumferential surface 344 of the cylindrical portion 34 and the balance weight 18A.

Figure 10:
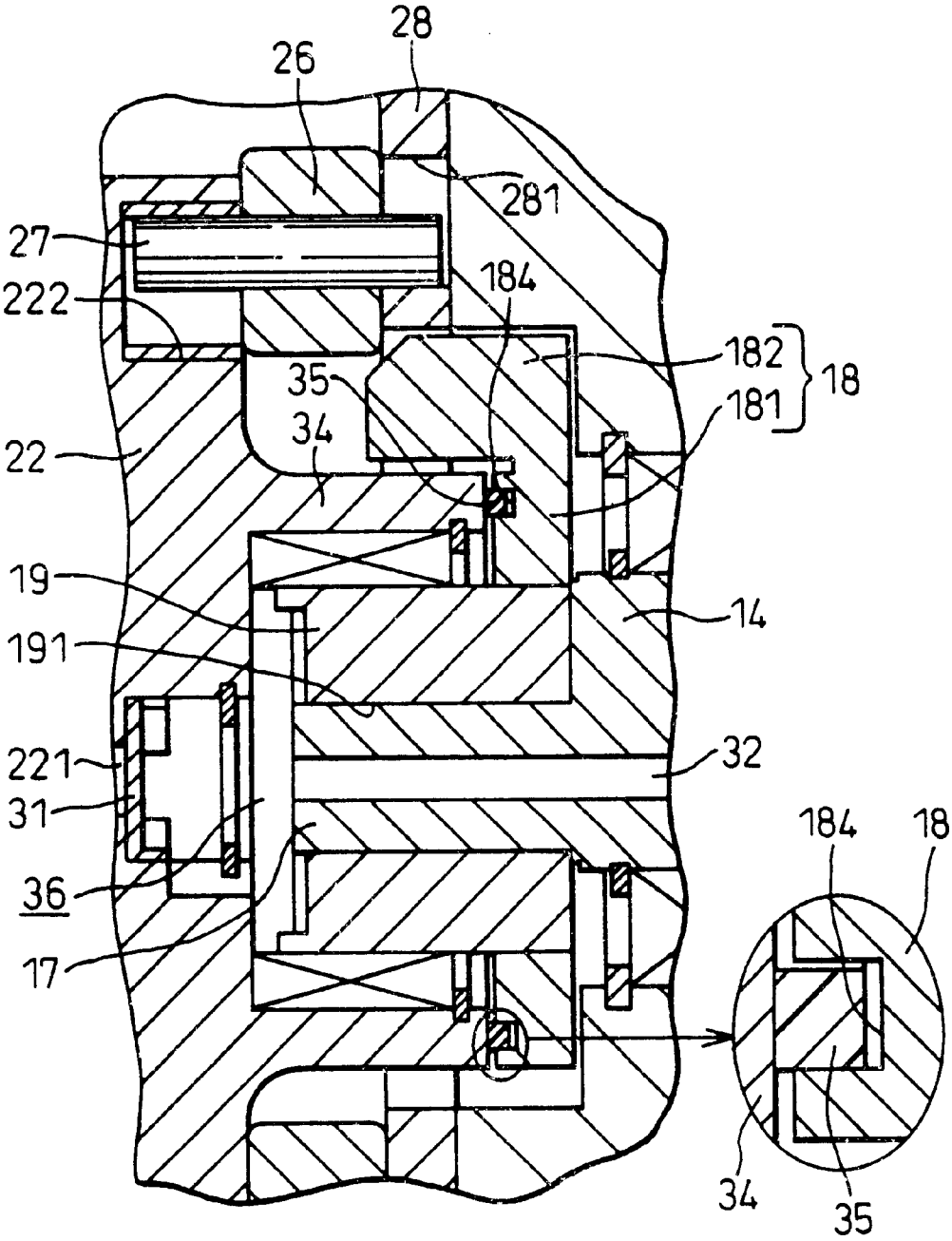
FIG. 10 is a profile cross-sectional view with the major components magnified in the sixth embodiment.

Next, the sixth embodiment shown in FIG. 10 is described. The same symbols are used for the same elements as in the first embodiment.

The seal member 35 is housed in an annular housing groove 184 formed at the end surface of the ring portion 181 of the balance weight 18. The seal member 35 is designed so at to be pressed to and made to come into contact with the end surface of the cylindrical portion 34 and the circumferential surface at the radially outer side of the housing groove 184.

As mentioned in detail above, because the back pressure chamber, which is opposed to the movable scroll, is formed by the movable scroll, the eccentric rotation body, and the seal member in the present invention, an excellent effect that the pressure leakage from the back pressure chamber installed at the back side of the movable scroll to the low pressure area can be prevented is obtained.

While the invention has been described by reference to specific embodiments chosen for the purposes of illustration, it should be apparent that numerous modifications could be made thereto by those skilled in the art without departing from the basic concept and scope of the invention.

We claim:

1. A seal structure in a scroll type compressor, wherein:

a fixed scroll, on the base of which a fixed scroll wall is formed, is opposed to a movable scroll, on the base of which a movable scroll wall is formed;

a hermetic space, the volume of which decreases according to the orbital movement of the movable scroll, is formed between the movable scroll wall and the fixed scroll wall; and the movable scroll is designed so as to orbit when a rotational force of a drive shaft is transmitted to a orbital movement mechanism, which has an eccentric shaft in order to orbit the movable scroll; and wherein:

the eccentric axis of an eccentric rotation body that eccentrically and integrally rotates with the eccentric shaft is allowed to move relative to the eccentric axis of the movable scroll;

a seal member is interposed between the movable scroll and the eccentric rotation body so that the seal member circumscribes the eccentric axis of the eccentric shaft; and a back pressure chamber, which is opposed to the movable scroll, is formed by the movable scroll, the eccentric rotation body and the seal member.

2. A seal structure in a scroll type compressor, as set forth in claim 1, wherein the eccentric rotation body is a balance weight attached to the orbital movement mechanism.

3. A seal structure in a scroll type compressor, as set forth in claim 2, wherein:

the orbital movement mechanism comprises an eccentric shaft that rotates integrally with the drive shaft and a transmitting means of eccentric rotation interposed between the eccentric shaft and the movable scroll;

the transmitting means of eccentric rotation comprises a cylindrical portion that is provided so as to protrude from the movable scroll base and a bushing that rotates both integrally with the eccentric shaft and relatively to the cylindrical portion in a cylinder of the cylindrical portion;

the balance weight is fixed to the bushing; and the seal member is interposed between the end surface of the cylindrical portion and the balance weight.

4. A seal structure in a scroll type compressor, as set forth in claim 3, wherein an annular housing groove is formed on the end surface of the cylindrical portion and the seal member is housed in the housing groove.

5. A seal structure in a scroll type compressor, as set forth in claim 3, wherein an annular protruding portion is formed on the end surface of the cylindrical portion and the seal member is arranged radially inner side the annular protruding portion.

6. A seal structure in a scroll type compressor, as set forth in claim 3, wherein the bushing can slidably move with respect to the eccentric shaft.

7. A seal structure in a scroll type compressor, as set forth in claim 1, wherein the back pressure chamber is made to be a discharge pressure area.

8. A seal structure in a scroll type compressor, as set forth in claim 7, wherein a discharge port is installed on the movable scroll base and the discharge port is communicated with the back pressure chamber.

* * * * *